US006536248B1

(12) United States Patent
Fan

(10) Patent No.: US 6,536,248 B1
(45) Date of Patent: Mar. 25, 2003

(54) DOOR LOCK-AND-HANDLE ASSEMBLY

(76) Inventor: Fang-Yi Fan, No. 186, Min-Kuo Rd., Chia-Yi City (TW)

( * ) Notice: Subject to any disclaimer, the term of this patent is extended or adjusted under 35 U.S.C. 154(b) by 0 days.

(21) Appl. No.: 09/994,949

(22) Filed: Nov. 27, 2001

(51) Int. Cl.[7] ..... E05B 55/04

(52) U.S. Cl. ..... 70/467; 70/150; 70/471; 70/476; 70/483; 292/169.15; 292/169.18

(58) Field of Search ..... 70/467–471, 473, 70/474, 476, 477, 479–481, 483, 487, 150, 153, 210; 292/DIG. 26, 169.15, 359, 169.17, 169.18

(56) References Cited

U.S. PATENT DOCUMENTS

| | | | | |
|---|---|---|---|---|
| 1,755,434 A | * | 4/1930 | Ellingson | |
| 2,219,740 A | * | 10/1940 | Hillgren | |
| 2,220,591 A | * | 11/1940 | Voight et al. | |
| 2,263,477 A | * | 11/1941 | Voight | |
| 2,344,484 A | * | 3/1944 | Ledin et al | |
| 2,431,814 A | * | 12/1947 | Lickteig | |
| 2,435,238 A | * | 2/1948 | Schlage | |
| 2,473,080 A | * | 6/1949 | Vander Henst | |
| 2,503,192 A | * | 4/1950 | Cerf, Jr. | |
| 2,593,573 A | * | 4/1952 | Kulbersh | |
| 4,143,529 A | * | 3/1979 | Brummett et al. | 70/152 |
| 4,295,349 A | * | 10/1981 | Wasserfaller | 70/111 |
| 5,259,652 A | * | 11/1993 | Adams et al. | 292/169.14 |

FOREIGN PATENT DOCUMENTS

| | | | | |
|---|---|---|---|---|
| CA | 514455 | * | 7/1955 | 70/479 |
| SU | 1647112 | * | 5/1991 | 70/467 |

* cited by examiner

*Primary Examiner*—Lloyd A. Gall
(74) *Attorney, Agent, or Firm*—Harness, Dickey & Pierce, P.L.C.

(57) ABSTRACT

A door lock-and-handle assembly includes a housing receiving a latch bolt therein, a spindle for driving the latch bolt between extended and retracted positions, a handle coupled to the spindle, a sliding member connected to the latch bolt, a driving member coaxially coupled to the spindle and engageable with the sliding member, a locking member movable between locked and unlocked positions to engage and disengage the driving member, and a lock releasing member including a cam mechanism that has a cam member and a cam follower formed on the sliding member and the locking member, respectively, for moving the locking member from the locked position to the unlocked position when the latch bolt is pushed toward the retracted position by an external force.

5 Claims, 8 Drawing Sheets

DOOR LOCK-AND-HANDLE ASSEMBLY

BACKGROUND OF THE INVENTION

This invention relates to a door lock-and-handle assembly, more particularly to a door lock-and-handle assembly with a lock releasing member.

The object of the present invention is to provide a door lock-and-handle assembly with a lock releasing member for preventing undesirable locking action of a lock unit thereof.

SUMMARY OF THE INVENTION

According to the present invention, a door lock-and-handle assembly is adapted to be mounted on a door panel, and comprises: a bolt receiving housing adapted to be mounted in the door panel and including a faceplate that is formed with a bolt opening; a latch bolt mechanism including a latch bolt mounted movably in the bolt receiving housing and movable in a transverse direction relative to the faceplate between extended and retracted positions for moving in and out of the bolt opening, and a latch biasing member that urges the latch bolt to move toward the extended position; a sliding member mounted slidably in the bolt receiving housing and connected to the latch bolt so as to be synchronously movable with the latch bolt in the transverse direction; a spindle defining an axis, extending through the bolt receiving housing in a direction transverse to the sliding member, and rotatable about the axis; inner and outer handles adapted to be mounted rotatably on two opposite sides of the door panel, respectively, and coupled to the spindle so as to be co-rotatable with the spindle about the axis; a driving member connected to and projecting from the spindle in a radial direction relative to the axis so as to be co-rotatable with the spindle about the axis between first and second angular positions, and engaging the sliding member so as to move the latch bolt from the extended position to the retracted position against urging action of the latch biasing member when the driving member moves from the first angular position to the second angular position, and so as to be moved from the second angular position to the first angular position when the latch bolt moves from the retracted position to the extended position by the urging action of the latch biasing member; a locking unit including a locking member mounted movably in the bolt receiving housing and movable in an axial direction parallel to the axis between a locked position, in which, the locking member engages the driving member so as to prevent co-rotation of the spindle and the driving member and sliding movement of the sliding member, and an unlocked position, in which, the locking member disengages from the driving member so as to permit co-rotation of the spindle and the driving member and sliding movement of the sliding member, the locking unit further including an operating lever connected to the locking member and having an operating end exposed from the bolt receiving housing for actuating the locking member to move between the locked and unlocked positions; and a lock releasing member including a cam mechanism that has a cam member formed on the sliding member, and a cam follower formed on the locking member, the cam member engaging the cam follower when the locking member is disposed at the locked position in such a manner that when the latch bolt is pushed and is moved in the transverse direction from the extended position to the retracted position, the cam member will move together with the sliding member in the transverse direction so as to drive the cam follower, which, in turn, results in axial movement of the locking member from the locked position to the unlocked position, thereby disengaging the locking member from the driving member and permitting co-rotation of the driving member and the spindle.

BRIEF DESCRIPTION OF THE DRAWINGS

In drawings which illustrate an embodiment of the invention.

DETAILED DESCRIPTION OF THE PREFERRED EMBODIMENT

Figure 1:
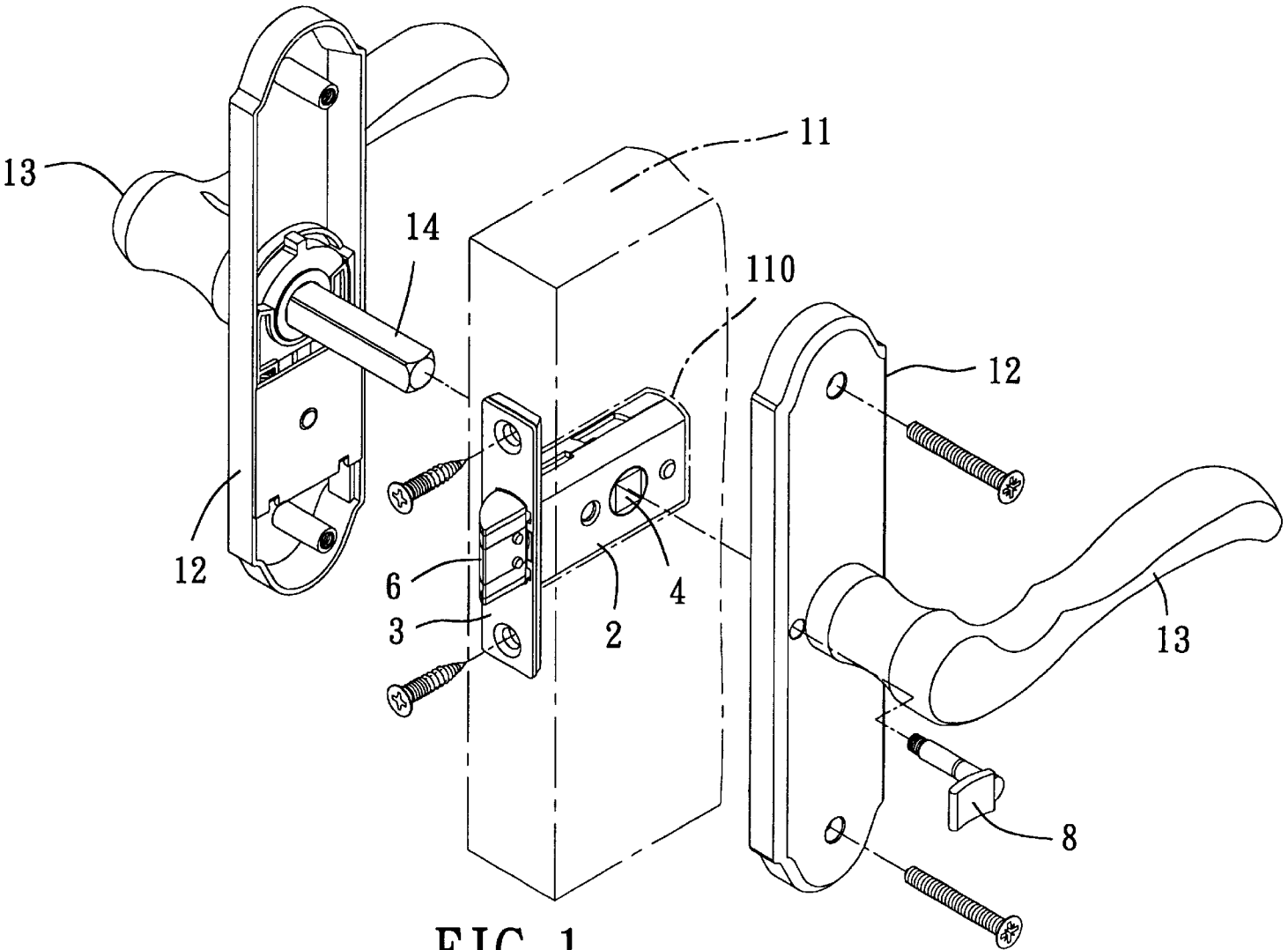
FIG. 1 is an exploded perspective view of a preferred embodiment of a door lock-and-handle assembly of this invention which is to be mounted on a right-hand side door panel.

FIGS. 1 to 7 illustrate a preferred embodiment of a door lock-and-handle assembly of this invention that is adapted to be mounted on a door panel 11 which is formed with a lock receiving hole 110.

The door lock-and-handle assembly is mounted on the door panel 11, and includes: a bolt receiving housing 2 adapted to be mounted in the lock receiving hole 110 in the door panel 11 and including a faceplate 21 that is formed with a bolt opening 211; a latch bolt mechanism including a latch bolt 6 mounted movably in the bolt receiving housing 2 and movable in a transverse direction relative to the faceplate 21 between an extended position (see FIGS. 6 and 7) and a retracted position (see FIGS. 4 and 5) for moving in and out of the bolt opening 211, and a latch biasing member 7 that urges the latch bolt 6 to move toward the extended position; a sliding member 5 mounted slidably in the bolt receiving housing 2 and connected to the latch bolt 6 so as to be synchronously movable with the latch bolt 6 in the transverse direction; a spindle 14 defining an axis, extending through the bolt receiving housing 2 in a direction transverse to the siding member 5, and rotatable about the axis; inner and outer handles 13 with escutcheons 12, the handles 13 being adapted to be mounted rotatably on two opposite sides of the door panel 11, respectively, and being coupled to the spindle 14 so as to be co-rotatable with the spindle 14 about the axis; a driving member 4 connected to and projecting from the spindle 14 in a radial direction relative to the axis so as to be co-rotatable with the spindle 14 about the axis between a first angular position (see FIG. 6) and a second angular position (see FIG. 4), and engaging the sliding member 5 so as to move the latch bolt 6 from the extended position to the retracted position against the urging action of the latch biasing member 7 when the driving member 4 moves from the first angular position to the second angular position, and so as to be moved from the second angular position to the first angular position when the latch bolt 6 moves from the retracted position to the extended position by the urging action of the latch biasing member 7; a locking unit including a locking member 81 mounted movably in the bolt receiving housing 2 and movable in an axial direction parallel to the axis between a locked position (see FIG. 7) in which, the locking member 81 engages the driving member 4 so as to prevent co-rotation of the spindle 14 and the driving member 4 and sliding movement of the sliding member 5, and an unlocked position (see FIG. 5), in which, the locking member 81 disengages from the driving member 4 so as to permit co-rotation of the spindle 14 and the driving member 4 and sliding movement of the sliding member 5, the locking unit further including an operating lever 82 that has a threaded end 821 threadedly connected to the locking member 81 and an operating end 822 exposed from the bolt receiving housing 2 for actuating the locking member 81 to move between the locked and unlocked positions; and a lock releasing member including a cam mechanism that has a cam member 91 formed on the sliding member 5, and a cam follower 92 formed on the locking member 81. The cam member 91 engages the cam follower 92 when the locking member 81 is disposed at the locked position in such a manner that when the latch bolt 6 is pushed and is moved in the transverse direction from the extended position to the retracted position, the cam member 91 will move together with the sliding member 5 in the transverse direction so as to drive the cam follower 92, which, in turn, results in axial movement of the locking member 81 from the locked position to the unlocked position, thereby disengaging the locking member 81 from the driving member 4 and permitting co-rotation of the driving member 4 and the spindle 14.

The bolt receiving housing 2 further includes opposite first and second side walls 23, 22 connected to and transverse to the faceplate 21 and extending in the transverse direction. The sliding member 5 is disposed adjacent to the first side wall 23, and includes a generally U-shaped part that has a basin portion 51 and two opposing arm portions 52 extending from two opposite ends of the basin portion 51 in the transverse direction away from the latch bolt 6, and a connecting part 54 extending from the basin portion 51 in the transverse direction to connect with the latch bolt 6. The arm portions 52 of the U-shaped part define a gap 53 therebetween. One of the arm portions 52 has a driven protrusion 522 projecting therefrom in the axial direction toward the second side wall 22. The driving member 4 is disposed between the second side wall 22 and the sliding member 5, and includes a cylindrical part 41 that is coaxially coupled to the spindle 14 and that extends through the gap 53 toward the first side wall 23, and a driving protrusion 422 that projects from the cylindrical part 41 in the radial direction and that has a slide engaging side 4221 which is engageable with the driven protrusion 522 when the driving member 4 moves between the first and second angular positions.

The driving member 4 further includes a second protrusion 423 cooperating with the driving protrusion 422 to define a lock engaging groove 421 therebetween which is opposite to the slide engaging side 4221 of the driving protrusion 422. The locking member 81 includes a cylindrical body 812 disposed between the first side wall 23 and the sliding member 5, connected to the operating lever 82, and extending in the axial direction, and an arcuate engaging tongue 811 projecting from one end of the cylindrical body 812 in the axial direction into the gap 53. The engaging tongue 811 moves into and engages the lock engaging groove 421 so as to prevent co-rotation of the driving member 4 and the spindle 14 when the locking member 81 is moved to the locked position, and moves out and disengages from the lock engaging groove 421 so as to permit co-rotation of the driving member 4 and the spindle 14 when the locking member 81 is moved to the unlocked position.

The first side wall 23 of the bolt receiving housing 2 is formed with a lock receiving recess 234 that receives the locking member 81 when the locking member 81 is positioned at the unlocked position. The locking member 81 further includes a sector-shaped part 813 projecting from the cylindrical body 812 in the radial direction and defining the cam follower 92, and a pivot pin 814 extending from one side of the sector-shaped part 813 in the axial direction through the gap 53 and pivoted to the second side wall 22. At least one of the arm portions 52 of the U-shaped part of the sliding member 5 has a lock engaging section 524 that defines the cam member 91 and that has an inclined cam face 911 facing the gap 53 and inclining at an angle relative to a horizontal plane which is transverse to the faceplate 21 and the first and second side walls 23, 22. The sector-shaped part 813 of the locking member 81 moves into the gap 53 and engages the inclined cam face 911 so as to be driven by the cam member 91 when the locking member 81 is moved to the locked position, and moves out of the gap 53 and disengages from the inclined cam face 911 when the locking member 81 is moved to the unlocked position.

The latch biasing member 7 includes two coil springs 71. The arm portions 52 of the U-shaped part are formed with spring receiving recesses 523 that receive the coil springs 71 so as to urge the latch bolt 6 via the sliding member 5.

The bolt receiving housing 2 further includes top and bottom walls 24, 25 that are formed with two opposing limiting slots 241. The sliding member 5 further includes a pair of stoppers 521 protruding from the arm portions 52 of the U-shaped part into the limiting slots 241 so as to limit movement of the latch bolt 6 between the extended and retracted positions.

With the provision of the cam mechanism (91, 92) of the lock releasing member, in case the locking member 81 is undesirably positioned at the locked position when the door panel 11 is moving toward a striking plate 3 on a door frame (not shown) , as the latch bolt 6 strikes the striking plate 3 and is forced to move toward the retracted position, the sliding member 5 will be moved together with the latch bolt 6 so as to move the locking member 81 from the locked position to the unlocked position via the cam action of the cam mechanism (91, 92), thereby permitting co-rotation of the driving member 4 and the spindle 14 and preventing undesirable locking of the latch bolt 6.

Figure 2:
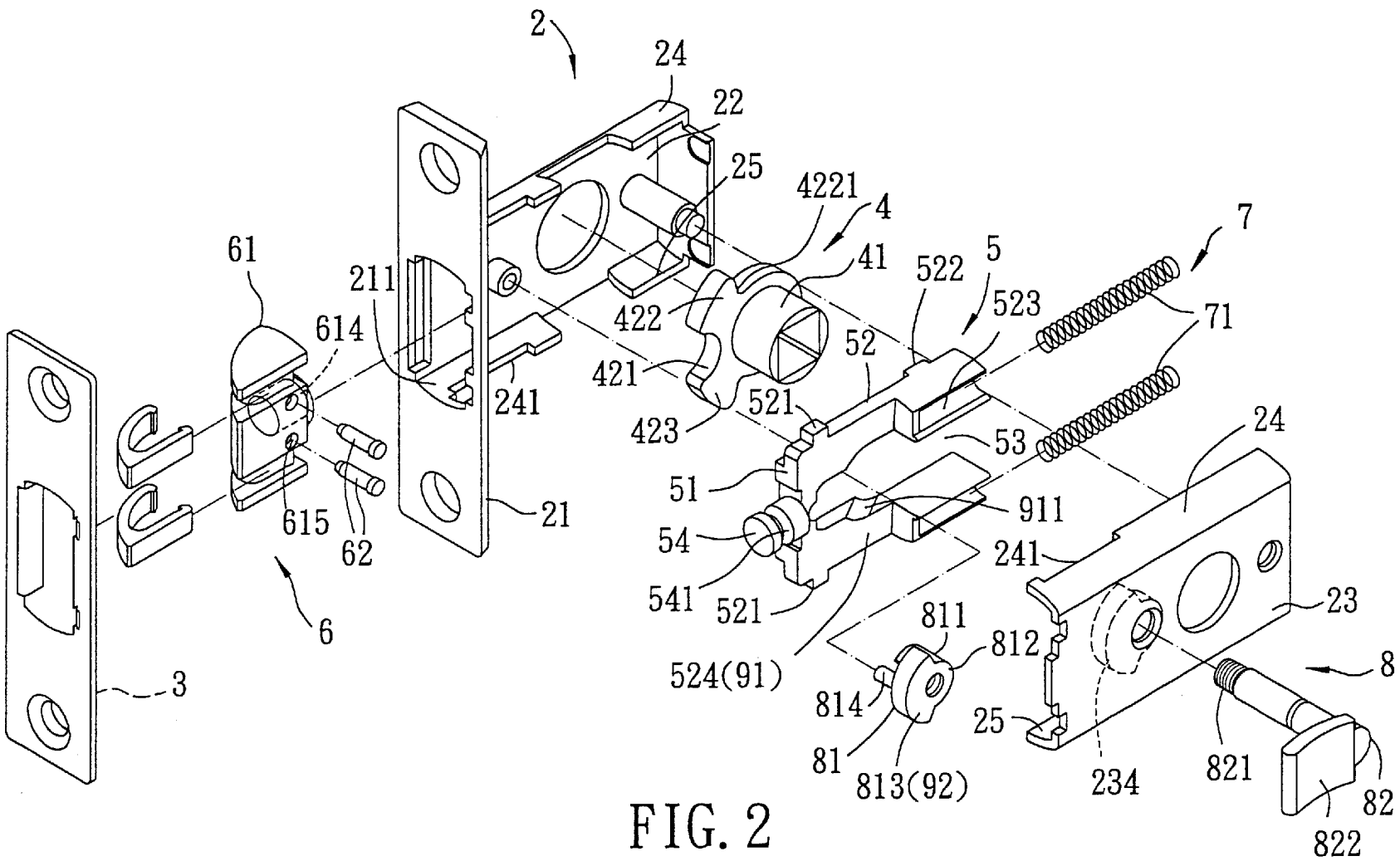
FIG. 2 is a fragmentary exploded perspective view of the door lock-and-handle assembly of FIG. 1.
Figure 3:
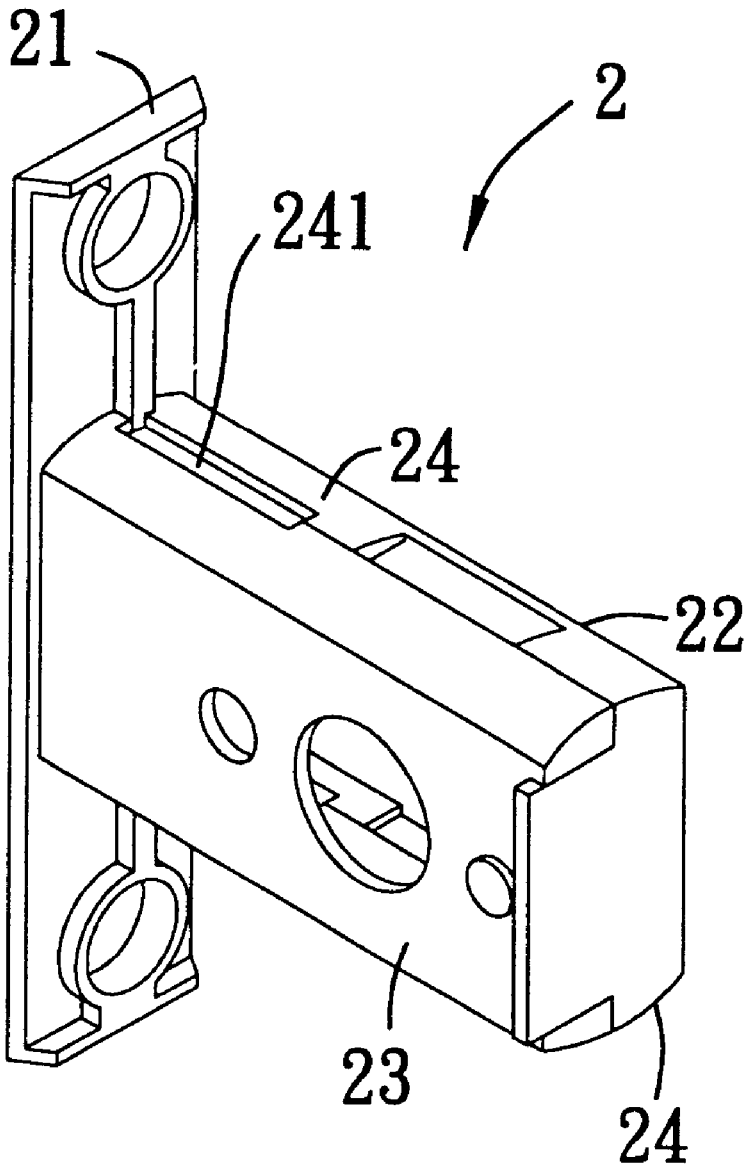
FIG. 3 is a perspective view of a bolt receiving housing of the door lock-and-handle assembly of FIG. 1.
Figure 4:
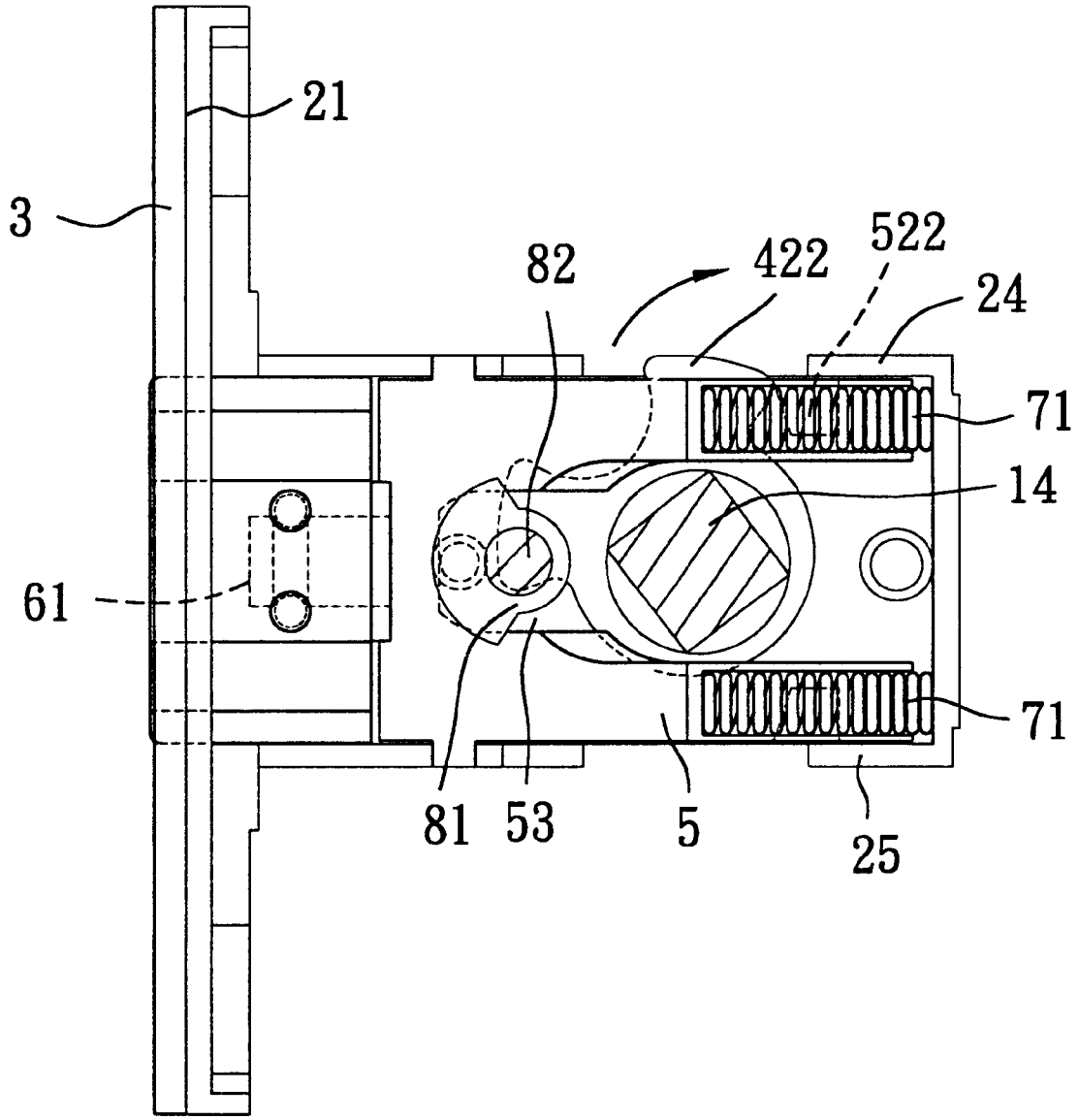
FIG. 4 is a fragmentary partly sectional schematic side view to illustrate a latch bolt of the door lock-and-handle assembly of FIG. 1 in a retracted position.
Figure 5:
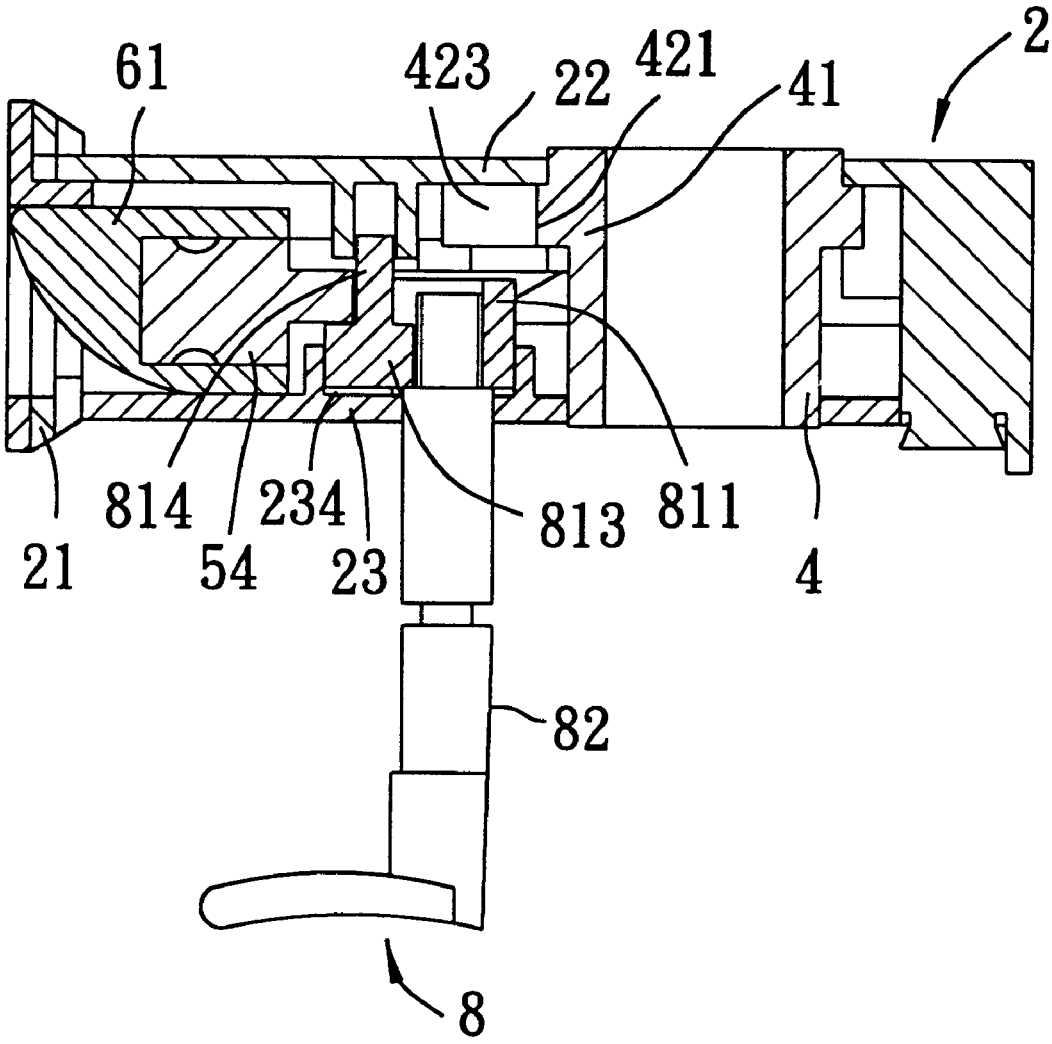
FIG. 5 is a fragmentary sectional top view to illustrate the latch bolt of FIG. 4 in the retracted position and a locking member of the door lock-and-handle assembly of FIG. 1 in an unlocked position.
Figure 6:
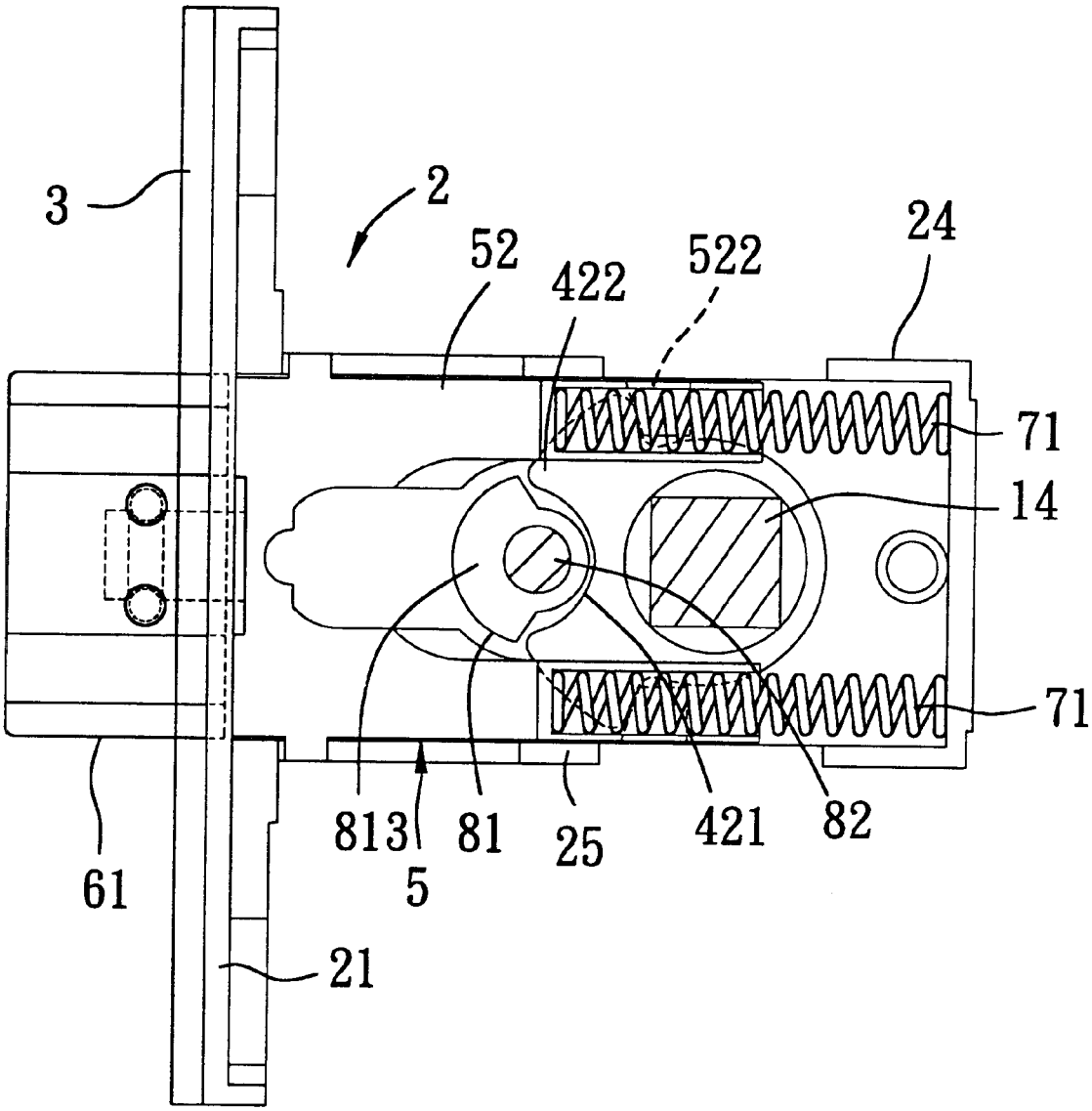
FIG. 6 is a fragmentary partly sectional schematic side view to illustrate the latch bolt of FIG. 4 in an extended position.
Figure 7:
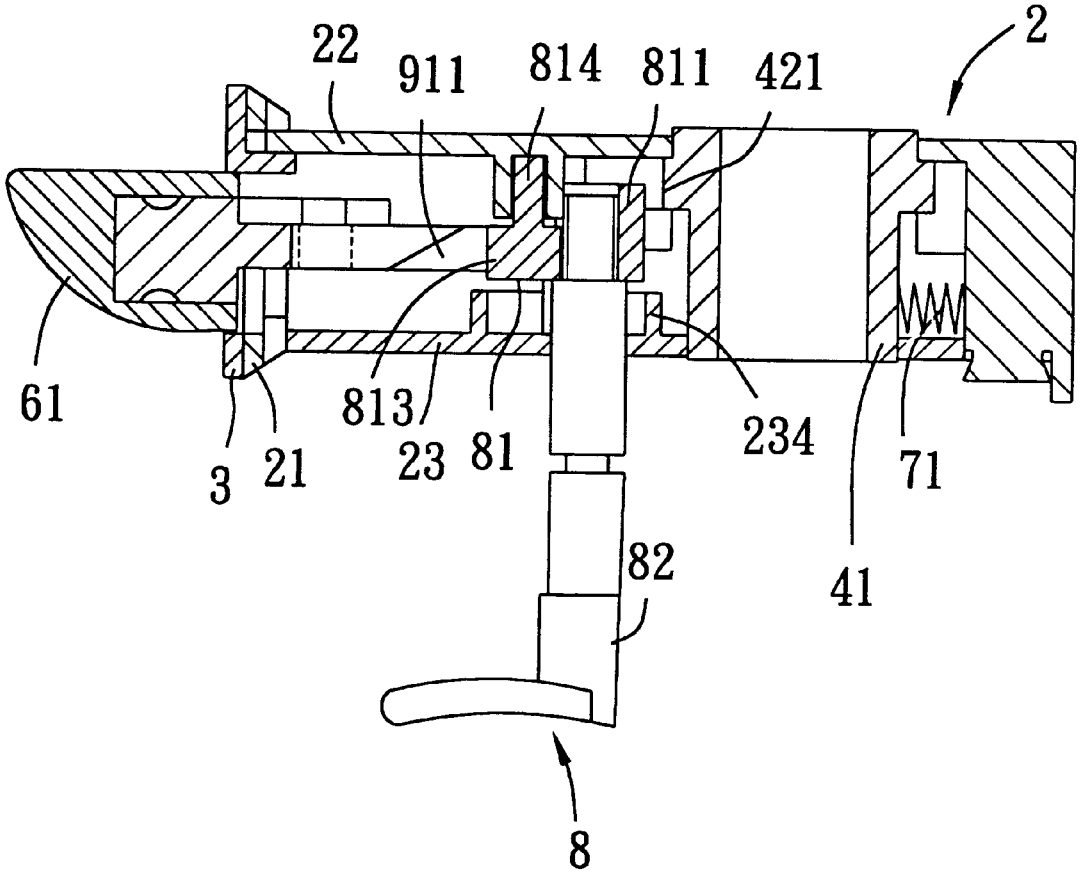
FIG. 7 is a fragmentary sectional top view to illustrate the latch bolt of FIG. 4 in the extended position and the locking member of FIG. 5 in a locked position.
Figure 8:
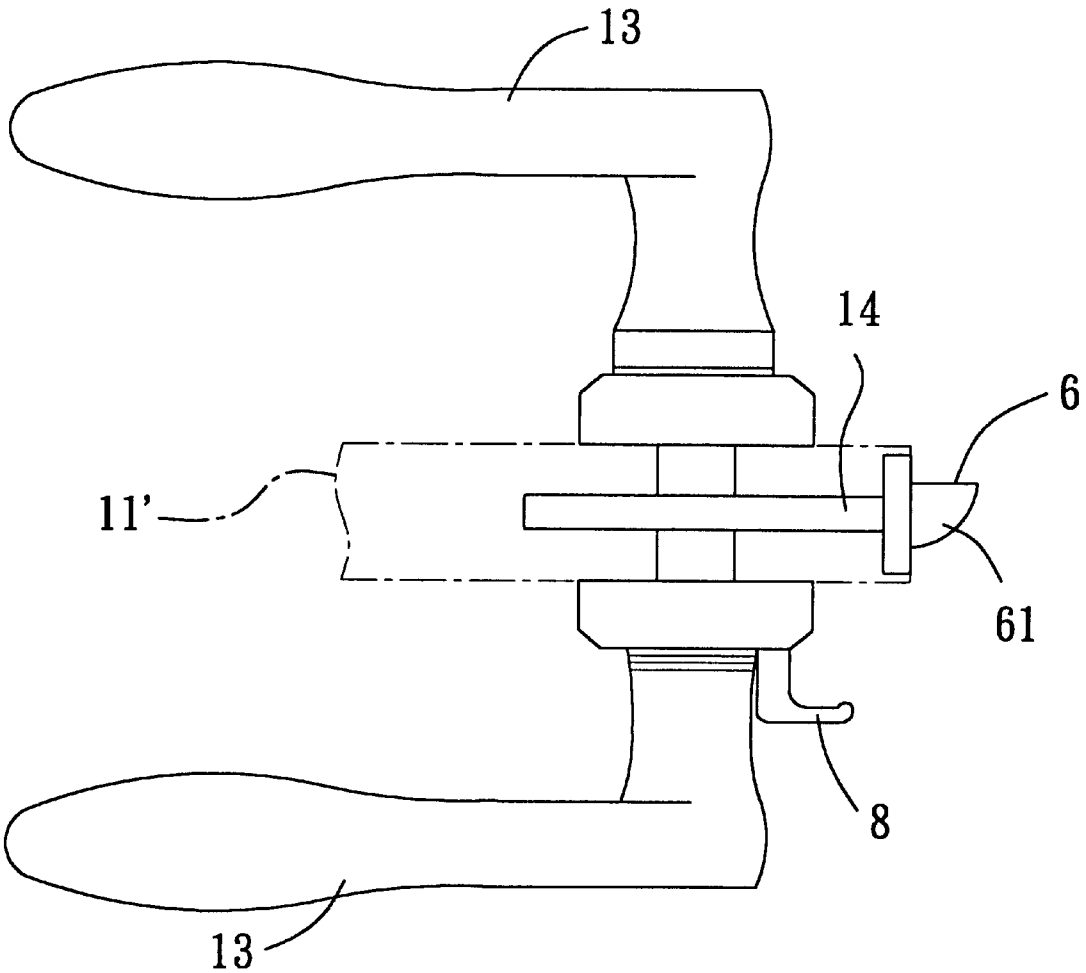
FIG. 8 is a top view to illustrate how the door lock-and-handle assembly of FIG. 1 can be adjusted for mounting on a left-hand side door panel.

With further reference to FIG. 8, in combination with FIG. 2, the latch bolt 6 includes a latch body 61 formed with a central hole 614 that receives the connecting part 54 of the sliding member 5. The connecting part 54 of the sliding member 5 is formed with an annular groove 541. The latch body 61 is further formed with a pair of through-holes 615 in spatial communication with the central hole 614. A pair of fixing pins 62 are fittingly inserted through the through-holes 615 and into the annular groove 541 so as to permit the latch bolt 6 to be secured to the connecting part 54 of the sliding member 5 at different angular positions relative to the connecting part 54, as best illustrated in FIG. 1, in which the latch bolt 6 is adapted for mounting on a right-hand side door panel 11, and in FIG. 8, in which the latch bolt 6 is adapted for mounting on a left-hand side door panel 11'.

With the invention thus explained, it is apparent that various modifications and variations can be made without departing from the spirit of the present invention. It is therefore intended that the invention be limited only as recited in the appended claims.

I claim:

1. A door lock-and-handle assembly adapted to be mounted on a door panel, said door lock-and-handle assembly comprising:

a bolt receiving housing adapted to be mounted in the door panel and including a faceplate that is formed with a bolt opening;

a latch bolt mechanism including a latch bolt mounted movably in said bolt receiving housing and movable in a transverse direction relative to said faceplate between extended and retracted positions for moving in and out of said bolt opening, and a latch biasing member that urges said latch bolt to move toward said extended position;

a sliding member mounted slidably in said bolt receiving housing and connected to said latch bolt so as to be synchronously movable with said latch bolt in said transverse direction;

a spindle defining an axis, extending through said bolt receiving housing in a direction transverse to said sliding member, and rotatable about said axis;

inner and outer handles adapted to be mounted rotatably on two opposite sides of the door panel, respectively, and coupled to said spindle so as to be co-rotatable with said spindle about said axis;

a driving member connected to and projecting from said spindle in a radial direction relative to said axis so as to be co-rotatable with said spindle about said axis between first and second angular positions, and engaging said sliding member so as to move said latch bolt from said extended position to said retracted position against urging action of said latch biasing member when said driving member moves from said first angular position to said second angular position, and so as to be moved from said second angular position to said first angular position when said latch bolt moves from said retracted position to said extended position by the urging action of said latch biasing member;

a locking unit including a locking member pivotally mounted in said bolt receiving housing and movable in an axial direction parallel to said axis between a locked position, in which, said locking member engages said driving member so as to prevent co-rotation of said spindle and said driving member and sliding movement of said sliding member, and an unlocked position, in which, said locking member disengages from said driving member so as to permit co-rotation of said spindle and said driving member and sliding movement of said sliding member, said locking unit further including an operating lever connected to said locking member and having an operating end exposed from said bolt receiving housing for actuating said locking member to move between said locked and unlocked positions; and a lock releasing member including a cam mechanism that has a cam member formed on said sliding member, and a cam follower formed on said locking member, said cam member engaging said cam follower when said locking member is disposed at said locked position in such a manner that when said latch bolt is pushed and is moved in said transverse direction from said extended position to said retracted position, said cam member will move together with said sliding member in said transverse direction so as to drive said cam follower, which, in turn, results in axial movement of said locking member from said locked position to said unlocked position, thereby disengaging said locking member from said driving member and permitting co-rotation of said driving member and said spindle.

2. The door lock-and-handle assembly of claim 1, wherein said bolt receiving housing further includes opposite first and second side walls connected to and transverse to said faceplate and extending in said transverse direction, said sliding member being disposed adjacent to said first side wall and including a generally U-shaped part that has a basin portion and two opposing arm portions extending from two opposite ends of said basin portion in said transverse direction away from said latch bolt, and a connecting part extending from said basin portion in said transverse direction to connect with said latch bolt, said arm portions of said U-shaped part defining a gap therebetween, one of said arm portions having a driven protrusion projecting therefrom in said axial direction toward said second side wall, said driving member being disposed between said second side wall and said sliding member and including a cylindrical part that is coaxially coupled to said spindle and that extends through said gap toward said first side wall, and a driving protrusion that projects from said cylindrical part in said radial direction and that has a slide engaging side which is engageable with said driven protrusion when said driving member moves between said first and second angular positions.

3. The door lock-and-handle assembly of claim 2, wherein said driving member further includes a second protrusion cooperating with said driving protrusion to define a lock engaging groove therebetween which is opposite to said slide engaging side, said locking member including a cylindrical body disposed between said first side wall and said sliding member, connected to said operating lever, and extending in said axial direction, and an arcuate engaging tongue projecting from one end of said cylindrical body in said axial direction into said gap, said engaging tongue moving into and engaging said lock engaging groove so as to prevent co-rotation of said driving member and said spindle when said locking member is moved to said locked position, said engaging tongue moving out and disengaging from said lock engaging groove so as to permit co-rotation of said driving member and said spindle when said locking member is moved to said unlocked position.

4. The door lock-and-handle assembly of claim 3, wherein said locking member further includes a sector-shaped part projecting from said cylindrical body in said radial direction and defining said cam follower, and a pivot pin extending from one side of said sector-shaped part in said axial direction through said gap and pivoted to said second side wall, one of said arm portions having a lock engaging section that defines said cam member and that has an inclined cam face facing said gap and inclining at an angle relative to a horizontal plane which is transverse to said faceplate and said first and second side walls, said sector-shaped part moving into said gap and engaging said inclined cam face so as to be driven by said cam member when said locking member is moved to said locked position, said sector-shaped part moving out of said gap and disengaging from said inclined cam face when said locking member is moved to said unlocked position.

5. The door lock-and-handle assembly of claim 4, wherein said latch biasing member includes at least a coil spring, at least one of said arm portions of said U-shaped part being formed with a spring receiving recess that receives said coil spring so as to urge said latch bolt via said sliding member.

* * * * *